United States Patent [19]

Bartlett

[11] Patent Number: 4,796,433

[45] Date of Patent: Jan. 10, 1989

[54] REMOTE RECONDENSER WITH INTERMEDIATE TEMPERATURE HEAT SINK

[75] Inventor: Allen J. Bartlett, Milford, Mass.

[73] Assignee: Helix Technology Corporation, Waltham, Mass.

[21] Appl. No.: 141,996

[22] Filed: Jan. 6, 1988

[51] Int. Cl.[4] ..... F17C 13/00

[52] U.S. Cl. ..... 62/54; 62/514 R

[58] Field of Search ..... 62/54, 514 R

[56] References Cited

U.S. PATENT DOCUMENTS

| | | | |
|---|---|---|---|
| 3,299,646 | 1/1967 | Stuart et al. | 62/40 |
| 3,360,955 | 1/1968 | Witter | 62/335 |
| 4,223,540 | 9/1980 | Longsworth | 62/514 R |
| 4,484,458 | 11/1984 | Longsworth | 62/514 JT |
| 4,543,794 | 10/1985 | Matsutani et al. | 62/54 |
| 4,575,386 | 3/1986 | Hamers | 62/54 |

OTHER PUBLICATIONS

CVI Incorporated, "CGR511-4.5 Ultralow Temperature System: 4.5 Kelvin Cryogenic Refrigeration System" Brochure.

Heatron, Inc., "Thermek" Brochure and Bulletin.

Noranda Metal Industries, Inc., "Forge Fin ®: Integral Inner-Fin Tubing" Brochure.

Summitomo Heavy Industries, Ltd., "Summitomo's Refrigerator" Brochure.

T. Koizumi, et al., "Recondensing Refrigerator for Superconducting NMR-CT", pp. 1-9.

Takashi Ishige, et al., "4.2K Refrigerator for SQUID Magnetometer" pp. 1-10.

*Primary Examiner*—Ronald C. Capossela

*Attorney, Agent, or Firm*—Hamilton, Brook, Smith & Reynolds

[57] ABSTRACT

A recondenser with a primary heat exchanging surface for recondensing boil-off within a cryostat provides a second heat exchanging surface for removing heat leak into the cryostat. The second surface is cooled by the same working fluid that cools the primary surface, but at a temperature intermediate that of the primary surface and associated cooling apparatus which is remote from the cryostat. An intermediate transfer line transfers working fluid from an intermediate portion of the cooling apparatus to the second surface which is in exchange relation with a radiation shield of the cryostat but is out of physical contact with the radiation shield. The cooling apparatus includes a mechanical refrigerator which further cools working fluid returned from the second surface through the intermediate transfer line. The intermediate transfer line is preferably positioned in a non-contact helical manner about a final transfer line which carries the working fluid to the primary surface. The two transfer lines form an assembly which is less than about one inch in outer diameter and is removeably positioned in the cryostat. The intermediate transfer line is thermally isolated from the final transfer line within the assembly.

28 Claims, 3 Drawing Sheets

REMOTE RECONDENSER WITH INTERMEDIATE TEMPERATURE HEAT SINK

BACKGROUND OF THE INVENTION

In a typical cryostat retaining a body of liquid cryogen, heat leaking in from the ambient environment is removed by boil-off of the cryogen. Generally, the cryostat has an outer housing, an inner container for the liquid cryogen, a transfer channel from the outer housing to the inner container and a radiation shield surrounding the inner container and in thermal contact with the transfer channel. The boil-off travels up through the transfer channel from the inner container in heat exchange relation with the radiation shield. The boil-off absorbs heat from the radiation shield and is vented to ambient through an outer end of the transfer channel. The amount of heat removed from the cryostat by the boil-off is not limited to the heat of vaporization of the cryogen alone, but is the combination of the heat of vaporization and the sensible heat gain in the gaseous cryogen as it warms to ambient conditions. For the low boiling point gases of Ne, $H_2$, He the sensible heat gain far outweighs the heat of vaporization.

If a recondenser is positioned in the transfer channel then the boil-off cooling of the cryostat must be replaced by the recondenser. Hence, the recondenser must extract the load associated with the lost sensible heat gain. This imposes a significantly higher heat load on the recondenser than one would calculate from the boil-off rate of the body of cryogen alone. A typical solution is to provide sufficient refrigeration at the boiling point temperature of the cryogen to handle the combined loads.

In a particular application to superconducting devices of today, a cryostat or vacuum jacketed reservoir of liquid cryogen is used to cool the device to achieve superconductivity. Typically the cryostat has a liquid cryogen boil-off rate of about 0.3 liters per hour. This equates to a heat leak of 0.212 watts to the liquid bath. When this boil-off is recondensed with a recondenser, the total heat leak to the liquid cryogen bath is over three watts which is an increase by a factor of fourteen. Accordingly in such superconducting devices and other applications employing a recondenser, there is a need for efficient management of heat leak into the cryostat.

SUMMARY OF THE INVENTION

It is an object of the present invention to provide a device which manages heat leak into a cryostat retaining a bath of liquid cryogen (i.e. helium). It is a further object of the present invention to provide such heat leak management with a cryogenic recondenser in which a cooling unit or cold box is remote from the cryostat and the recondensing surface is removeably positioned within the cryostat. Such a recondenser is disclosed in a related application Ser. No. 005,082 filed on Jan. 20, 1987 and assigned to the Assignee of the present application. The related application is herein incorporated by reference.

In a preferred embodiment of the present invention a stream of working cryogen gas is pre-cooled by remote cooling means which include a mechanical refrigerator positioned outside of the cryostat. The cryostat has an outer housing, an inner container for the liquid cryogen, a transfer channel from the outer housing to the inner container and a radiation shield surrounding the inner container and in thermal contact with the transfer channel. A transfer line extends from the remote cooling means and is removeably suspended in the transfer channel.

After the working gas has been pre-cooled within the cooling means, a final section of the transfer line carries incoming pre-cooled gas to a final JT valve and associated recondensing heat exchanger in the transfer channel of the cryostat. The pre-cooled gas is expanded through the final JT valve to form a cold, low-pressure mixture of cryogen liquid and gas in the recondensing heat exchanger. The recondensing heat exchanger passes the mixture in heat exchange relation with the boil-off from the retained cryogen bath to cool and recondense the boil-off. The gas from the cryogen mixture is returned from the recondensing heat exchanger to the cooling means through the final section of the transfer line in heat exchange relation with the incoming pre-cooled gas being carried to the final JT valve.

An intermediate section of the transfer line carries partially pre-cooled gas from and returns it to an intermediate portion of the remote cooling means. The intermediate section carries the working gas to a heat station positioned on the transfer line; the heat station is in thermal communication with, but out of physical contact with, the radiation shield to cool the radiation shield. The intermediate section of the transfer line and the final section of the transfer line are thermally isolated from each other such that gas carried in one is out of heat exchange relation with the gas carried in the other.

In a preferred design of the present invention, the final section of the transfer line is formed by two adjacent tubes. The two adjacent tubes extend longitudinally along the major axis of the transfer line. One of the adjacent tubes carries the incoming pre-cooled gas from the remote cooling means to the final J-T valve for expansion therethrough. The second adjacent tube transfers the pre-cooled gas, which has been expanded through the final J-T valve, from the recondensing heat exchanger back to a low pressure side of the cooling means for recycling. The two inner tubes are in thermal contact with each other to provide the heat exchange between the expanded pre-cooled gas and the incoming pre-cooled gas.

A main outer tube of the transfer line houses the two adjacent tubes which are thermally insulated from the main outer tube. In addition, the intermediate section of the transfer line is formed by a tube which at one end, within the main outer tube, is helically positioned about the two adjacent tubes of the final section in a contact free manner. The helical end of the tube is in physical and thermal contact with a portion of the main outer tube which serves as a heat station and is in thermal communication with but out of physical contact with the radiation shield of the cryostat. The heat station is thus cooled by the passing of pre-cooled gas from the remote cooling means through the helically wound end of the tube. The radiation shield is in turn cooled through convection and conduction in the gas which surrounds the heat station. With no physical coupling of the heat station to the radiation shield, the transfer line remains readily removable from the cryostat.

In a preferred embodiment, the tube of the intermediate section of the transfer line and the two adjacent tubes of the final section of the transfer line are thermally isolated from each other by spacers positioned throughout the main outer tube. This allows the pre-cooled gas being transferred in the intermediate section of the transfer line to be kept out of heat exchange relation with that being transferred in the final section of the transfer line.

The main outer tube, and thus the transfer line, is less than about one inch in finished outer diameter. The relatively small outer diameter enables the transfer line to be removeably positioned in the cryostat through narrow ports and confining neck or channel areas.

In a preferred design, the intermediate section of the transfer line carries working gas at a temperature intermediate to that of the working gas in the final transfer line and that of the working gas at the initial end of the remote cooling means. In particular the intermediate temperature is about 20° Kelvin. Further, the mechanical refrigerator is of the regenerator-displacer type such as the Gifford-MacMahon refrigerator. The intermediate section returns the working gas from the heat station on the transfer line in the transfer channel into heat exchange relationship with the second stage of the mechanical refrigerator.

In another design feature of the present invention, a recondensing heat exchanger is connected to the final J-T valve for receiving the expanded, pre-cooled gas and passing the same in heat exchange relation with the boil-off such that the boil-off is cooled and recondensed. Preferably, the recondensing heat exchanger has an inner tubing coaxially positioned within an outer tubing. The inner tubing receives the expanded, pre-cooled gas and passes it to the outer tubing in heat exchange relation with the boil-off. The outer tubing transfers the gas back to the low pressure side of the cooling means. The cryostat end of the outer tubing provides the primary recondensing surface. At that end, the outer tubing has a series of finger-like extensions or burrs extending radially outward from its outer surface to maximize heat exchanging surface area while allowing minimization of finished outer diameter.

In accordance with another design aspect of the invention, the cooling means comprises a first J-T valve for expanding the working gas to a lower pressure before final pre-cooling in the cooling means.

In a preferred embodiment, the volume of working gas is helium and the intermediate section of the transfer line carries a full flow of the volume of gas in series with that carried in the final section.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 5 is a longitudinal section through line V—V of the transfer line assembly of FIG. 2 rotated 90° from the longitudinal section of FIG. 3, and showing a J-T valve and coaxial heat exchanger employed by the present invention.

DETAILED DESCRIPTION OF THE PREFERRED EMBODIMENT

Figure 1:
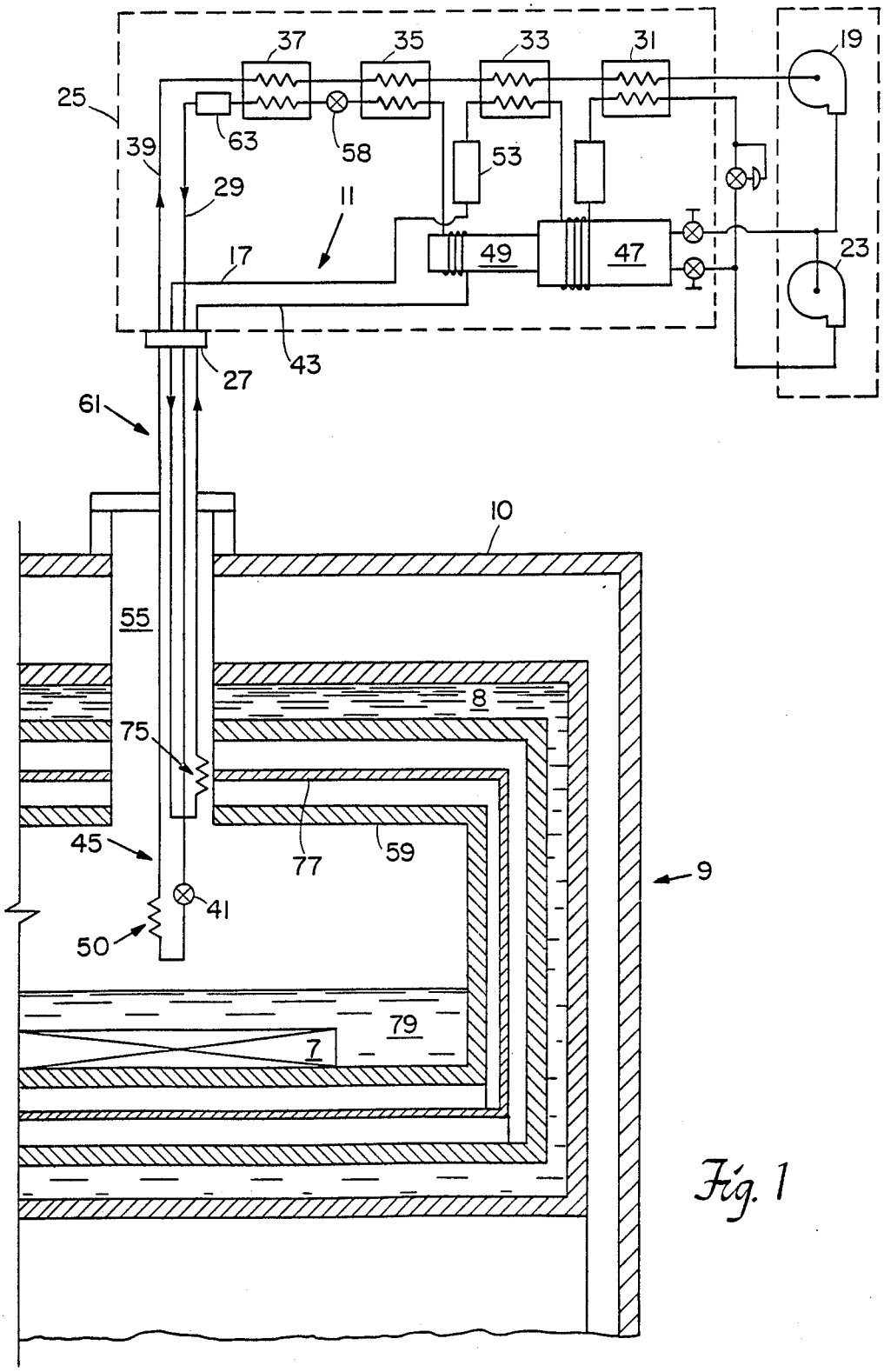
FIG. 1 is a schematic illustration of a cryogenic recondenser embodying the present invention and having cooling means remote from a cryostat in which recondensation occurs.

A cryogenic recondenser system embodying the present invention is schematically shown in FIG. 1. The illustrated recondenser provides refrigeration in a cryostat 10 which retains a bath of liquid cryogen 79 (i.e. Helium) for cooling a magnet 7 of a MRI (Magnetic Resonance Imaging) system 9. In such a system 9, an annular shaped vacuum jacketed structure 10 (the cryostat) houses the superconducting magnet 7. As the MRI system 9 is used, the magnet 7 is cooled in the bath of liquid cryogen 79 retained in vessel 59. Heat radiating from the room temperature walls of cryostat 10 is absorbed by a bath of liquid nitrogen 8 which encompasses vessel 59. Radiation shield 77 reduces the transfer of heat from the bath of liquid nitrogen 8 to the vessel 59 which contains the lower temperature cryogen 79. Boil-off from the cryogen 79 carries heat from vessel 59 up through a transfer channel area 55 which is in thermal contact with shield 77 and the bath of liquid nitrogen 8. The recondenser provides refrigeration in a manner which recondenses boil-off from the bath of liquid cryogen 79 as described in detail in U.S. patent application Ser. No. 005,082 and summarized hereafter. As disclosed by the present invention, the recondenser further provides refrigeration at a higher temperature in the transfer channel area 55 to cool radiation shield 77 to prevent heat leak from the liquid nitrogen bath 8 into cryostat 59.

The recondenser employs a volume of working cryogen gas (i.e. helium) which is compressed from about 1 atm. to about 7 atm. by a first staged compressor 19. The compressed gas is subsequently compressed through a second staged compressor 23 which generates a working gas at a high pressure of about 20 atm. The high pressure gas flows from compressor 23 to cooling means 25. Within cooling means 25, the gas is cooled to a temperature of about 10° Kelvin through heat exchangers 31, 47, 33, 49 and 35. Heat exchangers 31, 33 and 35 are counter flow heat exchangers and heat exchangers 47 and 49 are cooled by a mechanical refrigerator 57. The cooled gas is then expanded through J-T valve 58 to a temperature of about 8.5° Kelvin and a pressure of about 6 atm. The expanded gas is cooled through heat exchanger 37, of the counter flow type, to a temperature of about 5° Kelvin. The gas is then carried by a final heat exchange transfer line portion of a transfer line assembly 61 from the cooling means 25 into the vessel 59 in which refrigeration and recondensation of boil-off is to take place. The final heat exchanger transfer line 29, 39 provides further counter-flow heat exchange and further cools the working gas. A final J-T valve 41 is positioned at the cold end 45 of the transfer line assembly 61 placed in the subject cryostat 10. The cooled working gas is expanded through final J-T valve 41 from 6 atm. at about 5° Kelvin to about 1 atm. at about 4.2° Kelvin, at which point the helium gas turns to a liquid-gas mixture.

The liquid-gas mixture formed in cold end 45 of transfer line assembly 61 flows through a recondensing heat exchanger 50 which is in heat exchange relation with the boil-off from the contents of vessel 59. The formed liquid-gas mixture absorbs heat from the boil-off of cryogen retained in the vessel 59 and condenses the boil-off back into the vessel 59. Hence, cold end 45 provides the necessary refrigeration and heat exchanging surface for recondensation within vessel 59. The liquid-gas mixture having absorbed heat from the boil-off then forms a low temperature gas which is recycled through the final heat exchanger transfer line portion of transfer line assembly 61, back through the counter flow heat exchangers of cooling means 25 and to compressor 19.

In order to intercept heat leak into the vessel 59 from radiation shield 77, the present invention provides an intermediate temperature heat sink 75 in the cryostat in addition the primary recondensing surface of heat exchanger 50. The intermediate temperature heat sink 75 is provided by an intermediate transfer line 11 which is connected at one end to an intermediate portion of the cooling means 25 and has a cryostat end positioned adjacent to the radiation shield 77. The same working gas used to cool the primary recondensing surface 50 is used to cool the intermediate temperature heat sink 75 of intermediate transfer line 11. This is accomplished by diverting the flow of the working gas from heat exchanger 33 into the intermediate transfer line 11, passing the working gas to a heat station which is positioned on the transfer line assembly 61 in the transfer channel area 55 of the cryostat and is in thermal communication with the radiation shield 77, and returning the working gas through the intermediate transfer line 11 to heat exchanger 49. The returned working gas then continues through its normal cooling and expansion process to the final recondenser temperature in the primary recondensing surface 50 as previously described.

Figure 2:
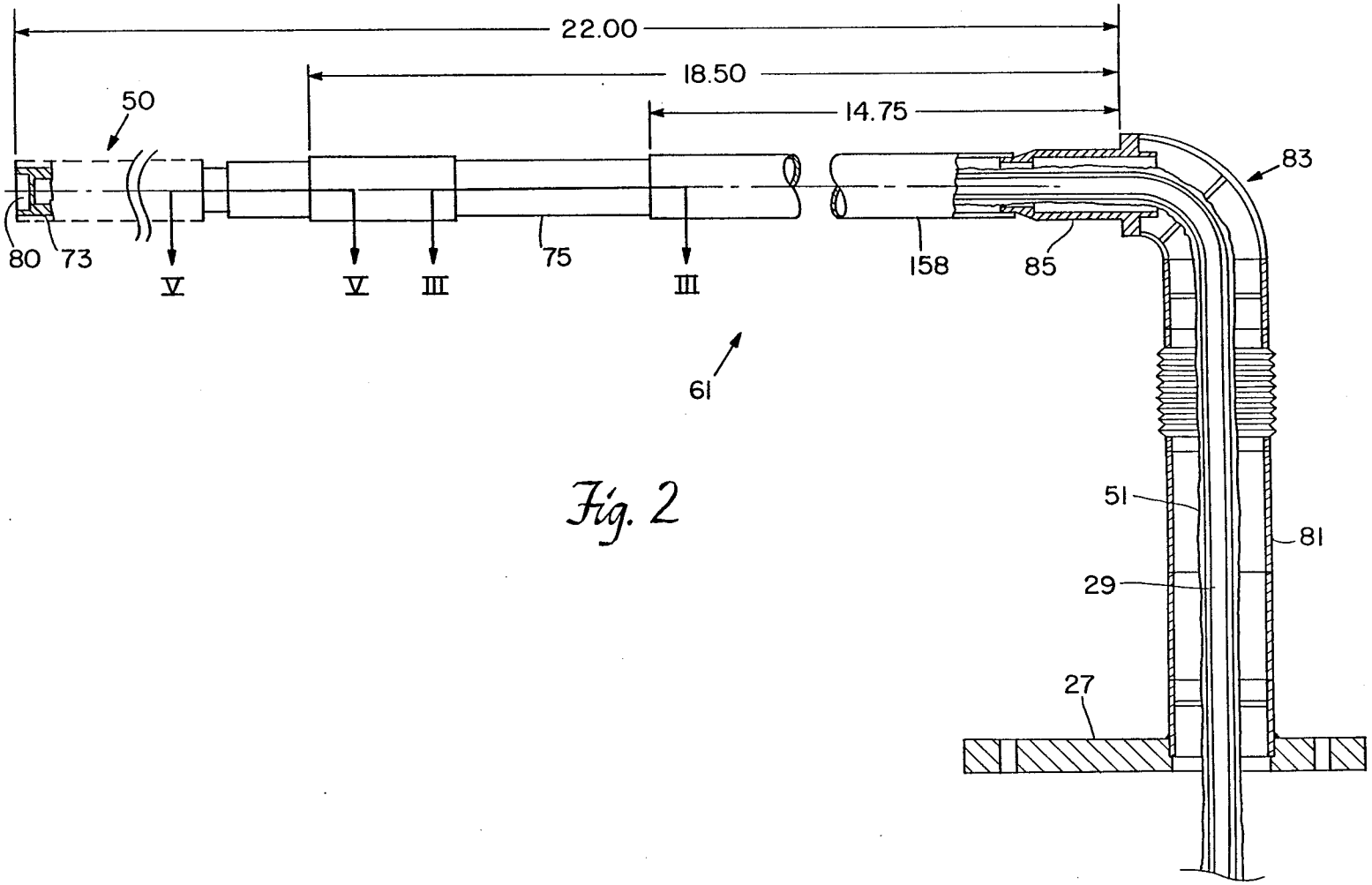
FIG. 2 is a side view, partially broken away, of a transfer line assembly embodying the present invention.

A more detailed illustration of the transfer line assembly 61 is provided in FIG. 2. The transfer line assembly 61 is attached to the cooling means 25 by connector piece 27. Main tubing 81, extending from connector piece 27, houses in a vacuum the intermediate transfer line 11 (shown in FIG. 3) and inner transfer tube 29 and inner return tube 39 (shown in FIG. 3) which form the final heat exchanger transfer line portion of the transfer line assembly 61. Inner transfer tube 29 and inner return tube 39 are positioned adjacent each other and extend longitudinally along the major axis of main tubing 81. Inner transfer tube 29 serves as an extension of the line leading from adsorber 63, of FIG. 1. Inner return tube 39 is the line through which the working gas is returned to the low pressure side of cooling means 25 to be recycled. In particular, inner return tube 39 is connected to the line entering the low pressure side of heat exchanger 37 of FIG. 1. The adjacent inner tubes 29, 39 are bonded together along longitudinal sides to provide a final counterflow heat exchange of the working gas prior to expansion of the working gas through final J-T valve 41.

Inner tubes 29 and 39 have outer diameters of about 3/16 inch and the outer diameter of main tubing 81 is less than about 1.5 inches. Both inner tubes 29, 39 comprise stainless steel. A multi-layer radiation shield 51 comprising aluminized mylar is wrapped around the inner tubes 29 and 39 to prevent heat leak from ambient.

Elbow 83 provides about a 90° curve connecting main tubing 81 to tube transition 85. Inner tubes 39 and 29 have corresponding elbows within elbow 83. The transfer line assembly 61 may be of other shapes for other cryostats in which case elbows of other degrees and other parts are used to aid in mechanical alignment.

Around the bend of the elbow 83, tubing transition 85 extends into a thin, poorly conducting stainless steel outer tubing 158 of about 15 inches in length. Outer tubing !58 is formed by a series of tubes having outer diameters of about $\frac{7}{8}$ inch or less joined end to end. Such construction enables easy insertion and removal of the transfer line assembly 61 into narrow access parts of a cryostat of about one inch in diameter. Tubing 158 further provides a continuation of the vacuum housing for parallel inner tubes 29 and 39.

Figure 3:
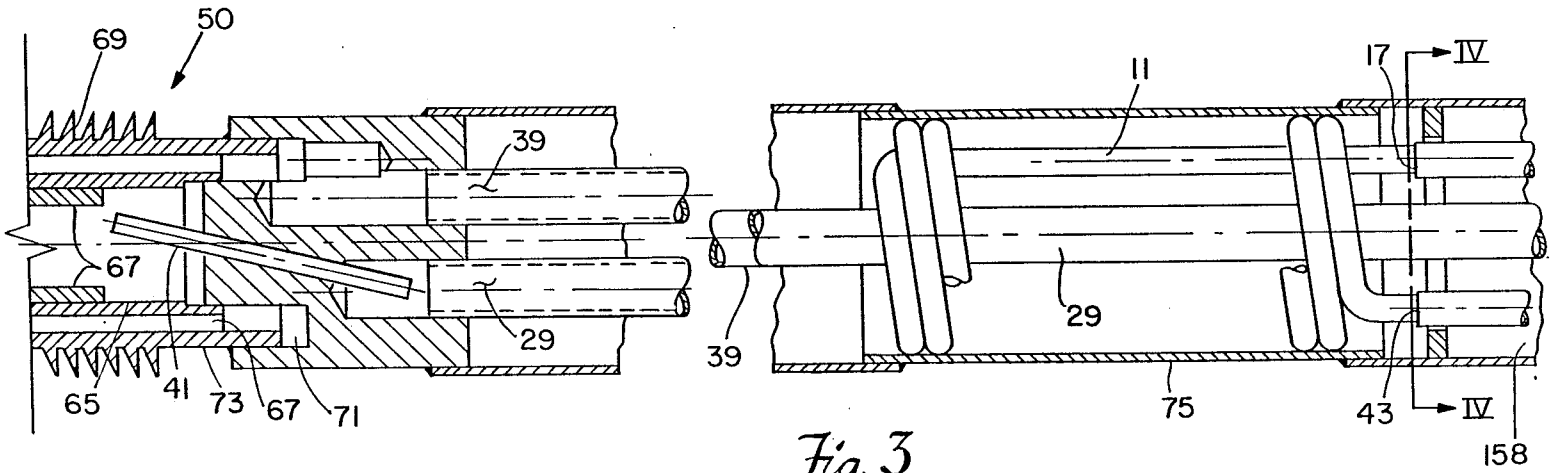
FIG. 3 is a longitudinal section through line III—III of the transfer line assembly of FIG. 2.

As shown in FIG. 3, the coldest end (i.e. the end furthest into the cryostat) of intermediate transfer line 11 is coiled about inner transfer lines 29 and 39 in a helical, contact free manner. Intermediate transfer line 11 has an outer diameter of about 3/32 inch and carries the working gas from and back to an intermediate portion of the cooling means 25. Specifically, uncoiled incoming end 17 of intermediate transfer line 11 is connected to a line leading from adsorber 53 of FIG. 1 and transfers the partially cooled working gas at a temperature intermediate that of the working gas in inner transfer tube 29 and the working gas initially entering the cooling means 25 from compressor 23. Preferably the intermediate temperature is about 20° Kelvin. Returning end 43 of intermediate transfer line 11 is connected to the line entering heat exchanger 49 of FIG. 1 to return the working gas to the cooling means 25 for further cooling.

Figure 4:
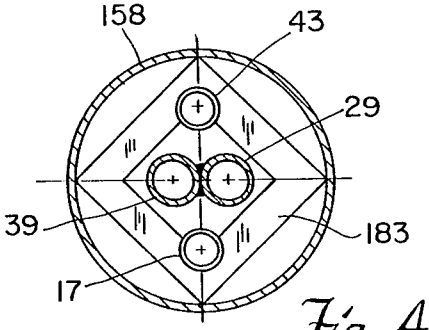
FIG. 4 is a cross section through line IV—IV of the transfer line assembly of FIG. 3.

Both uncoiled ends 17, 43 of intermediate transfer line 11 are about $\frac{1}{8}$ inch in outer diameter. The uncoiled ends 17, 43 are also supported by spacers 183 to prevent thermal contact of intermediate transfer line 11 with inner tubes 29 and 39 of the final transfer line. A cross section of a spacer 183 is shown in FIG. 4. Other similar spacers 183 are positioned throughout outer tubing 158, elbow 83 and main tubing 81 to support and isolate inner transfer tubes 29, 39 and ends 17, 43 of intermediate transfer line 11. The spacers 183 also insulate inner transfer tubes 29, 39 from outer tubing 158 and main tubing 81.

The coiled end of intermediate transfer line 11 is in thermal and physical contact with the inner wall of a portion 75 of outer tubing 158. Accordingly, portion 75 provides or serves as a 20° Kelvin heat station. The heat is subsequently absorbed by the intermediate temperature, partially cooled working gas flowing through the intermediate transfer line 11. As a result of the heat being absorbed from the transfer channel area 55, the radiation shield 77 of the cryostat 10 (FIG. 1) is cooled and relieved of excess heat. Thus, intermediate transfer line 11 provides for the removal of heat from the transfer channel area through a heat station 75 at about 20° Kelvin, and thereby serves as an intermediate temperature heat sink for the recondenser system.

After passing through the intermediate transfer line 11, working gas is further cooled in the remaining sections of the cooling means 25 which include the second stage 49 of mechanical refrigerator 57, heat exchangers 35, 37 and J-T valve 58 of FIG. 1. Preferably, the refrigerator 57 is of the regenerator displacer type, such as the Gifford-MacMahon cycle refrigerator. Other mechanical refrigerators are suitable.

After being further cooled by cooling means 25, the cooled working gas is passed to inner transfer tube 29 from adsorber 63 as previously mentioned. As shown in FIG. 5, the end of inner transfer tube 29 is connected to final J-T valve 41 through which the cooled working gas is expanded into coaxial heat exchanger and recondensing surface 50 at the cold end 45 of the transfer line assembly 61. The coaxial heat exchanger 50 is preferably formed by an inner tube 65 coaxially positioned within an outer tube 73, which provides the desired recondensing surface at a temperature of about 4.2° Kelvin. The liquidgas mixture formed upon expansion through final J-T valve 41 flows through the inner coaxial tube 65 in heat exchange relation with returning gas in the outer coaxial tube 73. End cap 80, shown in FIG. 2, plugs outer coaxial tube 73 at the cold end of the transfer line assembly 61. Hence, the working gas is prevented from communicating with the bath of cryogen retained in the cryostat and is transferred from inner coaxial tube 65 to outer coaxial tube 73. The liquid-gas mixture convectively absorbs heat as it is transferred in the inner and outer coaxial tubes 65, 73. The coaxial tubes 73, 65 absorb heat from the boil-off in the cryostat, thereby recondensing it, through outer burrs 69. Fins 67 protruding radially inward from the inner walls of outer coaxial tube 73 and inner coaxial tube 65 aid in transferring the absorbed heat to the liquid-gas mixture.

In a preferred design, inner coaxial tube 65 has an outer diameter of about 0.5 inch, and outer coaxial tube 73 is pressed around inner coaxial tube 65 such that fins 67 are in thermal contact with inner coaxial tube 65. This enhances the conductive transfer of heat from outer coaxial tube 73 to inner coaxial tube 65. Channels formed by the fins 67 between inner coaxial tube 65 and outer coaxial tube 73 carry the heat absorbing, liquid-gas mixture, in reverse direction back to inner return line 39 through a header connection 71. Thereafter, the working gas is recycled through the low pressure sides of the counter flow heat exchangers of cooling means 25 and passed to compressor 19.

Between final J-T valve 21 and end cap 80, the outer surface of outer coaxial tube 73 (i.e. the primary recondensing surface) comprises finger-like extensions or burrs 69 (FIG. 5) which are formed from the outer surface itself. The outer surface of outer coaxial tube 73 is radially shaved to lift edges of material away from the surface of the tube forming several burrs called spines. One type of such spining is performed by Heatron, Inc., York, Pennsylvania. In the preferred embodiment, outer coaxial tube 73 at end cap 80 has about 26 spines per turn with about 0.125 inch spacing between turns. The outer diameter of outer coaxial tube 73 around burrs 69 is less than about 0.9 inch which enables insertion of transfer line assembly 61 into narrow ports of the cryostat.

The spined surface of outer coaxial tube 73 provides an increase in surface area over other tubing used in prior art devices. The spined tubing provides a surface area per unit of projected area of about 5.

In sum, the present invention introduces a second surface (i.e. the cryostat end of an intermediate transfer line) at an intermediate temperature into a cryostat to provide a heat sink to absorb heat leak into the cryostat. The working gas and second surface remove heat from the radiation shield and transfer channel area of the cryostat and thereby enhance the efficiency of the recondenser to which the second surface is associated and which provides a primary heat exchanging surface for recondensing boil-off within the cryostat.

While the invention has been particularly shown and described with reference to a preferred embodiment thereof, it will be understood by those skilled in the art that various changes in form and details may be made therein without departing from the spirit and scope of the invention as defined by the appended claims. For example, a portion of the working gas may be diverted to cool the intermediate transfer line or second surface instead of the full flow of working gas. Further, the intermediate transfer line may transfer working gas from and return the same to a low pressure side of the cooling means instead of the high pressure side or a combination thereof. Additionally a third surface may be incorporated to adsorb heat at a temperature between room temperature and the intermediate temperature of 20K. A logical temperature for this surface would be 77K or less to adsorb heat for the liquid nitrogen reservoir 8 (FIG. 1). This surface would be cooled by extracting the gas flowing after heat exchanger 31 and returning it at heat exchanger 47 (FIG. 1). This surface could be used in concert with or in lieu of the 20K intermediate temperature surface. It is understood that cryostat design would dictate whether one, two or three surfaces would be employed.

I claim:

1. A cryogenic recondenser for recondensing cryogen retained in a storage vessel having a radiation shield, the recondenser comprising:

cooling means positioned outside of the storage vessel, the cooling means having a mechanical refrigerator and pre-cooling a volume of working gas;

an intermediate transfer line leading from an intermediate portion of the cooling means into the storage vessel;

an end of the intermediate transfer line in the storage vessel being in thermal communication with but out of physical contact with the radiation shield of the storage vessel, partially pre-cooled gas being transferred in the intermediate transfer line from the intermediate portion of the cooling means to the end of the intermediate transfer line and back to the cooling means for further cooling, said transferring being in a manner such that the end of the intermediate transfer line through the partially pre-cooled gas removes heat from the radiation shield; and a final transfer line removeably leading into the storage vessel from the cooling means, an end of the final transfer line in the storage vessel being in heat exchange relation with boil-off from the cryogen retained in the storage vessel, pre-cooled gas being transferred in the final transfer line from the cooling means to the end of the final transfer line in the storage vessel in a manner which cools and recondenses the boil-off.

2. A cryogenic recondenser as claimed in claim 1 wherein the final transfer line comprises two inner adjacent tubes positioned within an outer tube along axes parallel with a major axis of the outer tube, the pre-cooled gas being transferred from the cooling means to the end of the final transfer line in one inner tube and being transferred back to the cooling means for recycling in the other inner tube, the two inner tubes being in thermal contact with each other along adjacent sides, but insulated from the outer tube.

3. A cryogenic recondenser as claimed in claim 2 wherein the end of the intermediate transfer line is positioned about the two inner tubes in a contact free helical manner within the outer tube and is in physical and thermal contact with a portion of the outer tube positioned in the storage vessel to remove heat from the radiation shield, the portion of the outer tube being in thermal communication with but out of physical contact with the radiation shield.

4. A cryogenic recondenser as claimed in claim 3 wherein the portion of the outer tube is a heat station which is in thermal communication with but out of physical contact with the radiation shield.

5. A cryogenic recondenser as claimed in claim 3 wherein the outer tube has an outer diameter of less than about one inch.

6. A cryogenic recondenser as claimed in claim 2 further comprising:

a J-T valve connected to the one inner tube for receiving and expanding the pre-cooled gas; and a heat exchanger connected to the J-T valve for receiving the expanded pre-cooled gas and passing the same in heat exchange relation with the boil-off such that the boil-off is cooled and recondensed.

7. A cryogenic recondenser as claimed in claim 6 wherein the heat exchanger comprises a first tube coaxially positioned within a second tube, the first tube for receiving the expanded, pre-cooled gas from the J-T valve and passing the same to the second tube in heat exchange relation with the boil-off, the second tube for passing the expanded pre-cooled gas to the other inner tube of the final transfer line;

the second tube having an outer surface comprising a plurality of burrs.

8. A cryogenic recondenser as claimed in claim 6 wherein the cooling means includes a second J-T valve.

9. A cryogenic recondenser as claimed in claim 1 wherein the intermediate portion of the cooling means is between a first and second stage of the mechanical refrigerator, and the partially pre-cooled gas is returned to the second stage of the mechanical refrigerator from the end of the intermediate transfer line.

10. A cryogenic recondenser as claimed in claim 1 wherein the intermediate transfer line and the final transfer line are thermally isolated from each other such that working gas being transferred in the intermediate transfer line is kept out of heat exchange relation with that being transferred in the final transfer line.

11. A cryogenic recondenser as claimed in claim 1 wherein the final transfer line has an outer diameter of less than about one inch.

12. A cryogenic recondenser as claimed in claim 1 wherein the volume of working gas is helium.

13. A cryogenic recondenser as claimed in claim 1 wherein the intermediate transfer line carries a full flow of the volume of working gas in series with that of the final transfer line.

14. A cryogenic recondenser for recondensing gas evaporated from liquid cryogen retained in a storage vessel, the vessel having an outer housing, an inner container for liquid cryogen, a transfer tube from the outer housing to the inner container and a radiation shield surrounding the inner container and in thermal contact with the transfer tube, the recondenser comprising:

external cooling means including a mechanical refrigerator positioned outside of the storage vessel; and a transfer line extending from the external cooling means and removeably suspended in the transfer tube, the transfer line comprising:

a final section for transferring incoming cooled refrigerant from the external cooling means to a JT valve in communication with a recondensing heat exchanger and for returning refrigerant from the recondensing heat exchanger to the external cooling means in heat exchange relationship with the incoming refrigerant and an intermediate section for transferring cooled refrigerant from the external cooling means to a heat station positioned on the transfer line in thermal communication with but out of physical contact with the radiation shield to cool the radiation shield and for returning the refrigerant to the external cooling means out of heat exchange relationship with the incoming cooled refrigerant, the refrigerant of the final and intermediate sections of the transfer line being kept out of heat exchange relationship with each other.

15. A cryogenic recondenser as claimed in claim 14 wherein the transfer line has an outer diameter of less than about one inch.

16. A cryogenic recondenser as claimed in claim 14 wherein the refrigerant is helium.

17. A cryogenic recondenser as claimed in claim 14 wherein the intermediate section transfers a full flow of the refrigerant in series with that transferred by the final section.

18. A cryogenic recondenser as claimed in claim 14 wherein the final section comprises two adjacent tubes, the incoming cooled refrigerant being transferred to the J-T valve in one of the adjacent tubes and the refrigerant returned from the recondensing heat exchanger to the external cooling means in the other adjacent tube, the two adjacent tubes being in thermal contact with each other such that the returned refrigerant is in heat exchange relationship with the incoming refrigerant.

19. A cryogenic recondenser as claimed in claim 18 wherein the intermediate section comprises a tube helically positioned about the two adjacent tubes in a contact free manner and in thermal contact with the heat station on the transfer line to remove heat from the radiation shield.

20. A cryogenic recondenser as claimed in claim 18 wherein the recondensing heat exchanger comprises first and second coaxial tubes, the first tube for receiving refrigerant expanded through the J-T valve and passing the refrigerant to the second tube in heat exchange relation with the gas evaporated from the liquid cryogen retained in the storage vessel, the second tube passing the refrigerant to the other adjacent tube of the final section;

the outer of the first and second coaxial tubes having an outer surface with a plurality of burrs.

21. A cryogenic recondenser as claimed in claim 14 wherein the external cooling means comprises a second J-T valve.

22. A cryogenic recondenser for recondensing the gas evaporated from liquid cryogen retained in a storage vessel, the vessel having an outer housing, an inner container for liquid cryogen, a transfer tube from the outer housing to the inner container and a radiation shield surrounding the inner container and in thermal contact with the transfer tube, the recondenser comprising:

exterior cooling means including a mechanical refrigerator positioned outside of the storage vessel; and a transfer line extending from the exterior cooling means and removeably suspended in the transfer tube for transferring cooled refrigerant from the exterior cooling means to a recondensing heat exchanger, the transfer line further comprising a heat station at a mid-portion thereof positioned in the transfer tube and thermally isolated from the recondensing heat exchanger, the heat station being cooled by the refrigerant and in thermal communication with but out of physical contact with the radiation shield to cool the radiation shield.

23. A cryogenic recondenser as claimed in claim 22 wherein the transfer line is less than about one inch in outer diameter.

24. A cryogenic recondenser as claimed in claim 22 wherein the refrigerant is helium.

25. A method of recondensing boil-off from a bath of cryogen retained in a storage vessel, the vessel having an outer housing, an inner container for liquid cryogen, a transfer tube from the outer housing to the inner container and a radiation shield surrounding the inner container and in thermal contact with the transfer tube, the method comprising the steps of:

cooling a volume of refrigerant in an external cooling means which is remote from the storage vessel;

transferring the cooled refrigerant in an intermediate section of a transfer line to a heat station position on the transfer line in thermal communication with but out of physical contact with the radiation shield to cool the radiation shield, the transfer line extending from the external cooling means and removably suspended in the transfer tube;

returning the cooled refrigerant through the intermediate section of the transfer line from the heat station to the external cooling means;

transferring incoming cooled refrigerant in a final section of the transfer line from the external cooling means to a JT valve in communication with a recondensing heat exchanger positioned in the inner container;

expanding the cooled refrigerant through the JT valve to form a liquid and gas refrigerant mixture in the recondensing heat exchanger which is in heat exchange relation with the boil-off to cool the boil-off and thereby recondense the boil-off; and returning the refrigerant from the recondensing heat exchanger to the external cooling means through the final section of the transfer line in heat exchange relationship with the incoming refrigerant, the refrigerant of the final and intermediate sections of the transfer line being kept out of heat exchange relationship with each other.

26. A method as claimed in claim 25 wherein the step of cooling the refrigerant includes passing the refrigerant through a first stage of a mechanical refrigerator of the regenerator-displacer type in the external cooling means.

27. A method as claimed in claim 25 wherein the gas is helium.

28. A method as claimed in claim 25 wherein the intermediate section of the transfer line and the final section of the transfer line are thermally isolated from each other.

* * * * *